United States Patent [19]

MacLean

[11] 4,314,676

[45] Feb. 9, 1982

[54] CRUSHING AND PULVERIZING APPARATUS

[76] Inventor: Torry F. MacLean, P.O. Box 512, Trona, Calif. 93562

[21] Appl. No.: 114,119

[22] Filed: Jan. 21, 1980

[51] Int. Cl.[3] ..... B02C 1/04

[52] U.S. Cl. ..... 241/169; 241/264

[58] Field of Search ..... 241/169, 262–269; 100/DIG. 2, 233

[56] References Cited

U.S. PATENT DOCUMENTS

| | | | |
|---|---|---|---|
| 350,494 | 10/1886 | Low | 241/264 |
| 1,241,646 | 10/1917 | Mathison | 241/263 |
| 2,047,566 | 7/1936 | Klingler | 241/169 |
| 2,208,165 | 7/1940 | Sheahan | 241/269 |
| 3,763,772 | 10/1973 | Baker | 241/267 X |
| 4,213,387 | 7/1980 | McCaney et al. | 100/DIG. 2 |

*Primary Examiner*—Howard N. Goldberg
*Attorney, Agent, or Firm*—Arthur L. Urban

[57] ABSTRACT

Crushing and pulverizing apparatus including a base portion, a jaw portion and a force applying portion; the base portion including a pair of generally vertically disposed, spaced base members, the jaw portion being disposed between the base members of the base portion, the jaw portion including a fixed jaw member and a movable jaw member extending between the base members of the base portion, the fixed jaw member being fixed with respect to the base members, the fixed jaw member including a lower first section and an upper second section extending upwardly therefrom, the lower first section being disposed at a slight angle to the vertical and the upper second section extending upwardly therefrom at an angle to the vertical substantially greater than the angle of the first section, the movable jaw member of the jaw portion being disposed adjacent the fixed jaw member, the movable jaw member being disposed at a slight angle to the vertical approximating that of the lower first section of the fixed jaw member, the force applying portion including a handle member disposed adjacent the upper sections of the base members and pivotally connected thereto, the movable jaw member being pivotally connected to the handle member adjacent the upper section of the movable jaw member.

10 Claims, 4 Drawing Figures

CRUSHING AND PULVERIZING APPARATUS

This invention relates to a novel crushing apparatus and more particularly relates to a new apparatus which performs both crushing and pulverizing functions.

Through the centuries, it frequently has been necessary to crush and/or pulverize rocks and stones for a variety of purposes. Rocks are crushed to provide a granular material for road building. Also, crushed stone is used as an aggregate material in concrete mixes.

Originally, rocks were crushed by hand, that is, using a sledge or similar tool. More recently, mechanical rock crushers have been employed where the quantity of material required justifies the capital investment. Most of the mechanical crushers are large in size and occupy considerable space. Generally, crushers work within a fairly narrow range of particle size. As a result, if a large reduction in size is desired, it is necessary to pass the material through the crusher a number of times with the appropriate adjustments being made to the crusher for each pass. Alternatively, a number of different crushers are used in series with each providing an incremental reduction in size.

In view of the limited size reduction for each pass through conventional rock crushers and the high cost of such machinery, the use of mechanical crushers ordinarily can be justified only where a large volume of material is needed at a specific location. These restrictions ordinarily limit the use of mechanical crushers to uses such as road bases, concrete mix aggregate and the like.

One field in which the use of mechanical crushers would be of considerable value is that of ore prospecting. Generally, prospectors inspect wide areas of the wilderness for likely appearing rock formations. When they do find rock formations that appear to be promising, they gather rock samples to be taken to assaying laboratories for a determination of their mineral content.

A serious problem in gathering rock samples for assaying is selection of typical rocks. If the rocks selected are not representative of the formations under consideration, the conclusions drawn from the analysis may be inaccurate. Thus, a mining venture may be undertaken based on an assay of rocks which are not representative. Although this situation always is possible, it is the desire of all prospectors to minimize this risk.

A variety of solutions have been proposed in attempts to provide more typical rock sampling. Some prospectors simply rely on their own visual expertise. Others collect a larger number of samples and submit portions of each sample for analysis. Still others crush and pulverize a number of rock samples and then blend the crushed samples to provide more uniformity of the specimens. Each of these methods requires extra effort on the part of the prospector. In the case of the blending of samples, the crushing and pulverizing ordinarily must be done by hand labor which is an especially burdensome chore.

Also, gold prospectors upon finding a possible gold-bearing rock must crush it by hand before they can pan the broken rocks to separate the gold. The crushing ordinarily is accomplished with a sledge and the pulverizing with a mortar and pestle. Both operations are very time-consuming. Thus, there is a need for a crusher which meets prospectors' requirements.

The present invention provides a novel crushing apparatus which is suitable for use by prospectors. The crushing apparatus of the invention is simple in design and convenient to use. The crushing apparatus is light in weight and can be carried into the field conveniently.

The crushing apparatus of the present invention is capable of providing a reduction in size from rocks several inches in diameter to fine granular particles in a single operation. The apparatus of the invention can be used after only a minimum of instruction by ordinary persons without special skills.

The apparatus of the invention provides an operator with a high degree of control of particle size. Furthermore, the operator can change the operation of the apparatus from the crushing of larger rocks to the pulverizing of the broken pieces quickly and simply without disrupting the operation of the apparatus.

The design of the crushing and pulverizing apparatus of the invention is simple in design and can be manufactured relatively inexpensively. The apparatus can be fabricated from commercially available materials utilizing conventional metal working techniques and semi-skilled labor.

Other benefits and advantages of the novel crushing and pulverizing apparatus of the present invention will be apparent from the following description and the accompanying drawings in which.

Figures 1, 2, 3, 4:
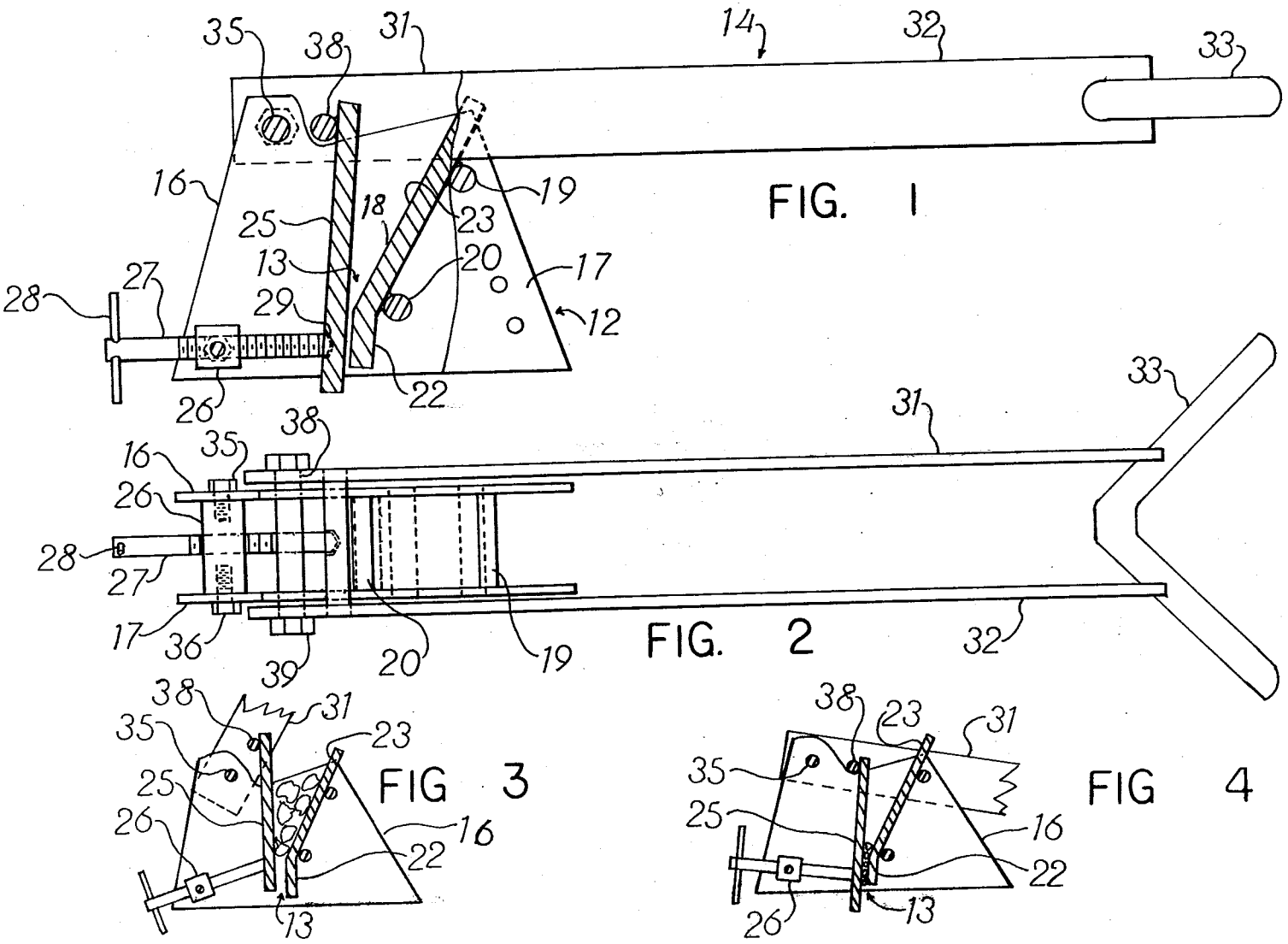
FIG. 1 is a side elevation partially in section of one form of the apparatus of the invention.
FIG. 2 is a top view of the apparatus shown in FIG. 1.
FIG. 3 is a schematic side view illustrating the apparatus shown in FIGS. 1 and 2 in a crushing operation.
FIG. 4 is a schematic side view illustrating the apparatus shown in FIGS. 1 and 2 in a pulverizing operation.

As shown in the drawings, one form of the novel crushing and pulverizing apparatus of the present invention includes a base portion 12, a jaw portion 13 and a force applying portion 14. The base portion 12 includes a pair of generally vertically disposed spaced base members 16 and 17. The jaw portion 13 is disposed between the spaced members 16 and 17 of the base portion 12.

The jaw portion 13 includes a fixed jaw member 18 and a movable jaw member 25 extending between the spaced members 16 and 17 of the base portion 12. The jaw member 18 is fixed with respect to the base members 16 and 17, advantageously through rods 19 and 20 affixed to the jaw member 18 and extending through openings in the base members.

The fixed jaw member 18 includes a lower first section 22 and an upper second section 23 extending upwardly therefrom. The upper section 23 has a vertical dimension substantially larger than the vertical dimension of the lower section 22. The lower section 22 is disposed at a slight angle to the vertical, preferably less than about 15°. The upper section 23 extends upwardly from the lower section 22 at an angle to the vertical substantially greater than the angle of the lower section, preferably between about 20° and 40°.

The movable jaw member 25 is disposed adjacent to the fixed jaw member 18. The movable jaw member 25 is disposed at a slight angle to the vertical approximating the angle of the lower section 22 of the fixed jaw member 18, and preferably less than about 15°. The movable jaw member 25 advantageously includes a substantially flat jaw surface. Preferably, the movable and fixed jaw members have substantially the same width and height with a height substantially greater than their width. In addition, the spacing between the upper edges of the movable and fixed jaw members when they are at their most remote positions is less than about one-half of the vertical dimension of the movable jaw member.

The lower section of the movable jaw member 25 engages means for adjusting the spacing between the lower section of the movable jaw member and the lower section 22 of the fixed jaw member 18. The adjusting means is disposed between the spaced base members 16 and 17 and pivotally connected thereto. Advantageously, the adjusting means includes a pivotally mounted threaded nut 26 and a screw 27 engageable therewith. Preferably, the adjusting means is disposed adjacent the lower section of the base members 16 and 17. Screw 27 may have a handle 28. The end of the screw 27 may engage a cavity 29 in the back of the movable jaw member 25 to maintain the jaw member in contact with the screw.

The force applying portion 14 includes a handle member disposed adjacent the upper sections of the spaced base members 16 and 17. The handle member is pivotally connected to the base members. The handle member as shown advantageously includes longitudinal sections 31 and 32 disposed on either edge of the movable jaw member 25. The handle member also may include a grip section 33 connecting the longitudinal sections 31 and 32. The handle member extends from the pivotal connection thereof with the base members 16 and 17 a substantial distance beyond the base portion 12. Advantageously, the length of the handle member is several times the height of the movable jaw member 25. As shown, the handle member may be pivotally connected to the base members through bolts 35 and 36.

The movable jaw member 25 is pivotally connected to the handle member adjacent the upper section of the movable jaw member. The pivotal connection of the movable jaw member 25 and the handle member is spaced from the pivotal connection between the handle member and the base members 16 and 17. The pivotal connection between the movable jaw member and the handle member may be achieved through a bolt 38 affixed to the upper section of the movable jaw member 25 that extends through the handle sections 31 and 32 and secured in place with nuts 39.

In the operation of the crushing and pulverizing apparatus of the invention as shown in the drawings, grip section 33 of the handle member is raised to move the top part of movable jaw member 25 away from the fixed jaw member 18. Next, rocks are placed into the space between the jaw members 18 and 25. The handle member then is depressed by applying pressure to grip section 33 thereof. This movement causes the upper section of movable jaw member 25 to move toward fixed jaw member 18 crushing the rocks disposed therebetween. As the handle member reaches a horizontal position, the movable jaw member 25 is at its closest point to the fixed jaw member 18.

Thereafter, the handle member is depressed further until it reaches its lowest position. At this point, the lower section of the movable jaw member is in a position in which it is at its most remote position from the lower section 22 of the fixed jaw member 18. Next, the handle member is raised by pulling up on grip section 33 thereof. Raising the handle member causes the lower section of movable jaw member 25 to move toward the lower section 22 of the fixed jaw member 18 pulverizing the broken pieces which are between the two lower sections.

The above pulverizing sequence may be repeated until all of the crushed rocks between the upper sections of the jaw members have been pulverized between the lower sections of the jaw members. Then, more rocks can be added to the space between the upper sections of the jaw members and the sequence repeated with the crushing operation being accomplished as the handle member is depressed from a raised position to a horizontal position and the pulverizing of the crushed rocks being performed thereafter when the handle member is raised from a depressed position to a horizontal position.

The relationship between the movement of the handle member and the movable jaw member 25 is such that the pivot point of the handle member and the upper section of the movable jaw member moves through an arc as the handle member is depressed from a raised position to a horizontal position with the pivot point being closest to the fixed jaw member when the handle is in a horizontal position. Likewise, the pivot point of the lower section of the movable jaw member 25, that is, the end of the screw 27 within cavity 29 moves through an arc as the handle member is raised from its lowest position to a horizontal position. The pivot point is closest to the lower section of the fixed jaw member when the handle is in a horizontal position and most remote when the handle member is in its lowest position.

The above description and the accompanying drawings show that the present invention provides a novel crushing apparatus which is simple in design and convenient to use. The crushing apparatus is particularly suitable for use by prospectors since it is light in weight and can be transported easily. In addition, the crushing apparatus of the invention provides both for the crushing and the subsequent pulverizing of the broken pieces. Thus, substantial reduction in particle size can be achieved with the apparatus even in a single operation. The apparatus of the invention is capable of crushing rocks several inches in diameter and thereafter in the same sequence pulverizing the broken pieces to a particle size of about 0.002 to 0.003 inch. Such results can be achieved consistently with the crushing apparatus of the invention after only a minimum of instruction by laymen without special skills.

The crushing apparatus of the present invention provides an operator with a high degree of versatility in controlling final particle size. Moreover, the operator can change the operation of the apparatus from a crushing sequence to a pulverizing sequence simply and quickly without disrupting the operation of the apparatus.

The crushing apparatus of the invention is simple in design and can be manufactured relatively inexpensively. The apparatus can be fabricated from commercially available materials employing conventional metal working techniques with semi-skilled labor.

It will be apparent that various modifications can be made in the particular apparatus described in detail above and shown in the drawings within the scope of the invention. For example, the size and configuration of components can be changed to meet specific requirements. Furthermore, while the apparatus ordinarily will be fabricated of high strength steel, it may be advantageous under certain conditions of operation to utilize other materials in its construction. Also, the force applying portion may include mechanical means such as pistons or motors. Therefore, the scope of the invention is to be limited only by the following claims.

What is claimed is:

1. Crushing and pulverizing apparatus including a base portion, a jaw portion and a force applying portion; said base portion including a pair of generally vertically disposed, spaced base members, said jaw portion being disposed between said base members of said base portion, said jaw portion including a fixed jaw member and a movable jaw member extending between said base members of said base portion, said fixed jaw member being fixed with respect to said base members, said fixed jaw member including a lower first section and an upper second section extending upwardly therefrom, said upper second section having a vertical dimension substantially larger than the vertical dimension of said lower first section, said lower first section being disposed at a slight angle to the vertical and said upper second section extending upwardly therefrom at an angle to the vertical substantially greater than the angle of said first section, said movable jaw member of said jaw portion being disposed adjacent said fixed jaw member, said movable jaw member being disposed at a slight angle to the vertical approximating that of the lower first section of said fixed jaw member, the lower section of said movable jaw member being disposed adjacent to the lower first section of said fixed jaw member, said lower section of said movable jaw member engaging means for adjusting the spacing between the lower sections of said movable jaw member and said fixed jaw member, said adjusting means being disposed between said base members and pivotally connected thereto, said force applying portion including a handle member disposed adjacent the upper sections of said base members and pivotally connected thereto, said handle member extending from said pivotal connection a substantial distance beyond said base portion, said movable jaw member being pivotally connected to said handle member adjacent the upper section of said movable jaw member, said pivotal connection between said movable jaw member and said handle member being spaced from said pivotal connection between said handle member and said base members, whereby movement of said handle member downwardly toward a horizontal position provides a crushing action between the upper sections of said movable and fixed jaw members and movement of said handle member upwardly toward a horizontal position provides a pulverizing action between the lower sections of said movable and fixed jaw members.

2. Crushing and pulverizing apparatus according to claim 1 wherein the upper and lower sections of said movable jaw member are disposed closest to said fixed jaw member when said handle member is in a substantially horizontal position.

3. Crushing and pulverizing apparatus according to claim 1 wherein said movable jaw member includes a substantially flat jaw surface.

4. Crushing and pulverizing apparatus according to claim 1 wherein the spacing between the upper edges of said movable and fixed jaw members when the handle member is in a raised position is less than about one-half the vertical dimension of said movable jaw member.

5. Crushing and pulverizing apparatus according to claim 1 wherein said movable and fixed jaw members have substantially the same width and height.

6. Crushing and pulverizing apparatus according to claim 5 wherein said movable and fixed jaw members have a height substantially greater than their width.

7. Crushing and pulverizing apparatus according to claim 1 wherein said adjusting means is disposed adjacent the lower sections of said spaced members of said base portion.

8. Crushing and pulverizing apparatus according to claim 1 wherein said adjusting means includes a pivotally mounted threaded nut and a screw engageable therewith.

9. Crushing and pulverizing apparatus according to claim 1 wherein the length of said handle member is several times the height of said movable jaw member.

10. Crushing and pulverizing apparatus according to claim 1 wherein said handle member includes a pair of longitudinally disposed sections disposed on either edge of said movable jaw member.

* * * * *